United States Patent [19]

Yoshiwara et al.

[11] Patent Number: 4,567,744

[45] Date of Patent: Feb. 4, 1986

[54] METHOD AND APPARATUS FOR FORMING LONG CYLINDRICAL METAL PRODUCTS

[75] Inventors: Seishiro Yoshiwara; Takao Kawanami, both of Kitakyushu, Japan

[73] Assignee: Nippon Steel Corporation, Tokyo, Japan

[21] Appl. No.: 571,534

[22] Filed: Jan. 17, 1984

[30] Foreign Application Priority Data

| | | | |
|---|---|---|---|
| Jan. 19, 1983 | [JP] | Japan | 58-5808 |
| Jan. 20, 1983 | [JP] | Japan | 58-6672 |
| Jan. 21, 1983 | [JP] | Japan | 58-7385 |
| Jan. 21, 1983 | [JP] | Japan | 58-7386 |
| Jul. 5, 1983 | [JP] | Japan | 58-121080 |

[51] Int. Cl.[4] ..... B21B 13/20

[52] U.S. Cl. ..... 72/68; 72/77

[58] Field of Search ..... 72/68, 77, 78, 96, 98, 72/99

[56] References Cited

U.S. PATENT DOCUMENTS

| | | | |
|---|---|---|---|
| 1,141,425 | 6/1915 | Simpkins | 72/103 |
| 3,182,475 | 5/1965 | Dilling | 72/77 |
| 3,217,521 | 11/1965 | Dilling | 72/77 |
| 3,349,594 | 10/1967 | Sporck | 72/78 |

FOREIGN PATENT DOCUMENTS

| | | | |
|---|---|---|---|
| 2019281 | 10/1979 | United Kingdom | 72/78 |
| 325055 | 1/1972 | U.S.S.R. | 72/77 |

*Primary Examiner*—Lowell A. Larson

*Attorney, Agent, or Firm*—Wenderoth, Lind & Ponack

[57] ABSTRACT

An apparatus and method for forming a cylindrical metal product. A housing having a housing axis therethrough aligned with a mill center line has a gear disposed therein having both sides rotatably supported in the housing for rotation about the housing axis. The gear has a tool holding opening therein the axis of which is offset from the mill center line, and is driven by a pinion. A ring-shaped tool is slidably rotatably fitted in the tool holding opening in the gear and is radially aligned with the gear and has an inner surface which circularly turns the outer surface of a metal workpiece to be formed into the cylindrical metal produce upon rotation of the gear. The metal workpiece is moved through the housing along the housing axis while being supported by supporting devices disposed upstream and downstream and closely adjacent the ring-shaped tool in the direction in which the metal workpiece is moved.

11 Claims, 14 Drawing Figures

METHOD AND APPARATUS FOR FORMING LONG CYLINDRICAL METAL PRODUCTS

BACKGROUND OF THE INVENTION

This invention relates to a method and apparatus for forming long cylindrical metal products constituted by solid or hollow cylindrical metal products, and more particularly to a method and apparatus for reducing, elongating and pre-forming pipes and bars having substantially circular cross-sections.

In today's seamless pipe manufacturing process, pipe rolling is carried out after piercing of a material bloom. In the rolling process, the pierced bloom is reduced and elongated to a pipe having a specified diameter on rolling equipment combining all or some of devices known as an elongator, plug mill, mandrel mill, reeler, sizer, reducer and other units. Because of the lower working efficiency of the individual units, however, conventional rolling equipment has required several to more than ten stands to achieve the desired result, which stands can be installed only at the expense of huge amounts of capital and large areas of space.

Bars are rolled by a rolling mill train comprising roughing, intermediate and finishing stands which add up to from several to more than ten in number, presenting problems similar to those experienced with pipe rolling.

Pipes and bars can be also manufactured by such plastic working methods as extrusion, drawing and forging, but these manufacturing technologies have been developed to the fullest extent and no room is left to achieve any further efficiency improvement.

On the other hand, conventional rolling mills for pipes and bars have entirely different structures. If their essential structures were the same, significant mill cost reduction would be achieved through the use of common or interchangeable parts, simplification of mill design, and reduction of mill varieties. It might also become possible even to reduce, elongate and preform pipes and bars on the same mill.

Such being the case, drastic technical innovation in pipe and bar manufacturing technologies has long been awaited.

SUMMARY OF THE INVENTION

An object of this invention is to provide a method and apparatus for forming long cylindrical metal products that permit reducing, elongating and preforming their materials with high efficiency.

Another object of this invention is to provide a method of forming long cylindrical metal products that permits reducing the size of the overall forming apparatus and reducing the number of devices making up the forming apparatuses made according to this concept.

Still another object of this invention is to provide a method of forming long cylindrical metal products that permits forming pipes and bars on apparatuses having essentially the same structure and forming apparatuses made according to this concept.

According to the forming method of this invention, a long cylindrical metal product is passed through a round hole in a ring-shaped tool, then the working face of the hole and the surface of the cylindrical product are pressed radially while causing the cylindrical product to move in the direction of the axis of the cylindrical product. The axis of the tool is caused to turn eccentrically about the mill centerline so that the tool rotates around the long cylindrical metal product.

Radially pressed by the working face of the round hole, the cylindrical product reduced in diameter and elongated axially. The rotational contact with the working face of the round hole brings the cross section of the cylindrical product into a truly round form. With the cylindrical product advancing with respect to the ring-shaped tool and the working face of the round hole turning over the peripheral surface of the cylindrical product, the forming action proceeds helically around said cylindrical surface.

A bloom is pierced by using a piercing mill or press. Then, the pierced bloom or a hollow shell is rolled between an advancing mandrel that is inserted therein and a ring-shaped tool encircling it.

An apparatus carrying out the forming operation just described has a tool holder rotatably attached to a housing. The tool holder, which is mounted in the center portion of a gear, is provided with an eccentric opening in which the ring-shaped tool is rotatably fitted. The ring-shaped tool has a round hole. The ring-shaped tool is adjoiningly preceded and followed by a pair of cylindrical product supports fastened to the housing. Each cylindrical product support has a round hole. The forming apparatus is also equipped with a device to rotate the tool holder and a device to push the cylindrical product into the hole in the ring-shaped tool.

The ring-shaped tool used in this invention has a working face on the internal side thereof, as contrasted with the conventional roll-forming tool that is a small disc having a working face on the periphery thereof. According to this invention, therefore, tool life can be increased by decreasing the load working thereon by lengthening the periphery thereof. The ring-shaped tool is simple and rigid enough to permit designing a mill that is compact but has a large enough capacity to provide heavy reduction. Compared with the conventional planetary cross rolling mill that rolls pipes or bars by rotating around the peripheries thereof the forming apparatus of this invention permits reducing the weight of the rotating section to under one-fifth that of the conventional apparatus. Because of the simple, round structure, the revolution of the forming tool can be made more than ten-fold greater, with a resulting remarkable increase in working efficiency. Compared with the conventional complex, huge and costly cross-roll mill that rolls pipes while rotating the workpiece, the forming apparatus of this invention is simple, compact and inexpensive The conventional planetary cross rolling and cross-roll mills develop heavy shear deformation on the workpiece. By contrast, the forming method and apparatus of this invention, which employ a ring-shaped tool rotating over the surface of the workpiece, can reduce such shear deformation, and the probability of surface defects development, to a minimum. Also, the forming method and apparatus of this invention can achieve a heavier cross-section reduction than, for example, the conventional mandrel mill. The upper limit of the reduction all types of the conventional pipe mills can achieve has been limited by the penetration of the workpiece into the clearance between rolls. With the method and apparatus of this invention that effect rolling at the internal working face of the ring-shaped tool, the risk of overfill is eliminated and the upper limit of reduction can therefore be raised significantly.

DETAILED DESCRIPTION OF THE PREFERRED EMBODIMENTS

Figure 1:
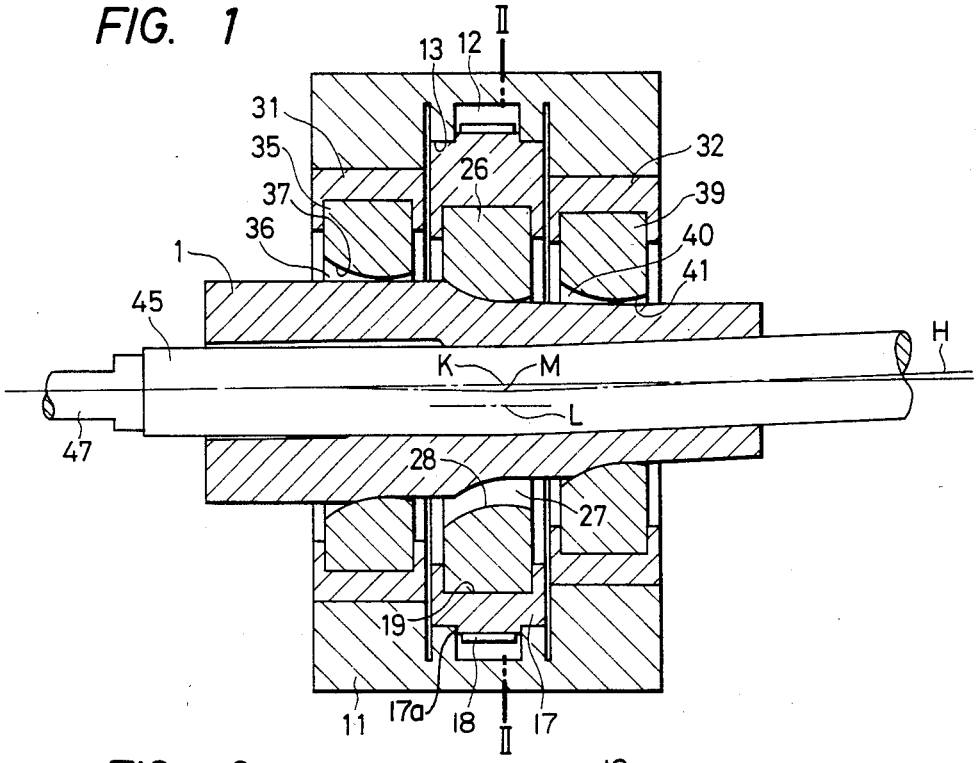
FIG. 1 is a longitudinal cross-section of a pipe forming apparatus on which a forming method of this invention is implemented.
Figure 2:
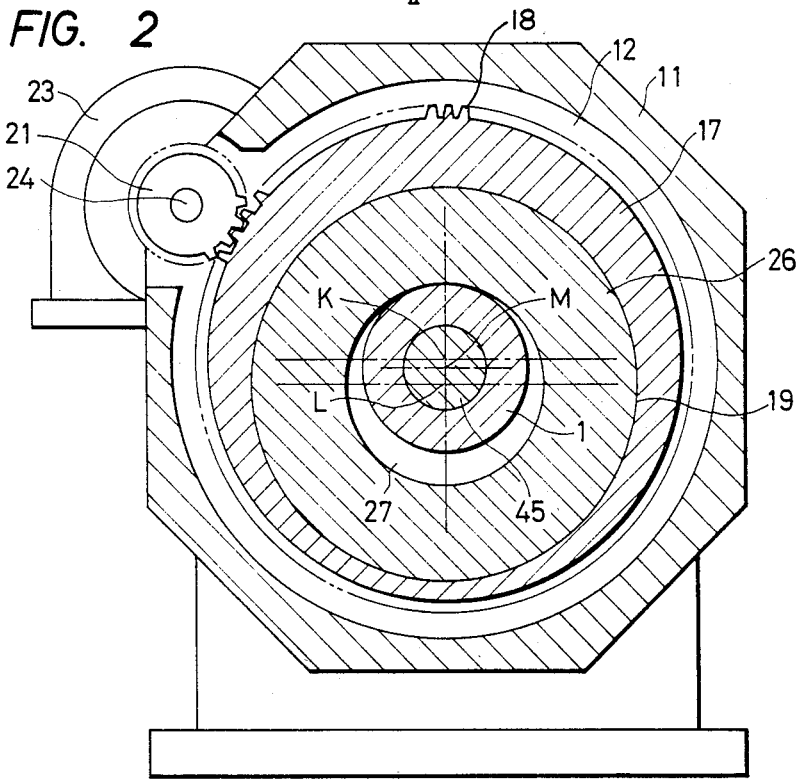
FIG. 2 is a cross-sectional view taken along the line II—II in FIG. 1.

FIGS. 1 and 2 show a pipe forming apparatus on which pipe is formed according to a forming method of this invention.

As illustrated, a gear chamber 12 is provided at the center of a housing 11, being preceded and followed (at the left-and right-hand side in FIG. 1) by a support hole 13.

A gear 17 is positioned in the gear chamber 12, with a rim 18 rotatably fitted in each support hole 13. A pinion 21 rotatably supported by the housing 11 engages with the gear 17. The pinion 21 is fastened to an output shaft 24 of a motor 23 equipped with a reduction gear. The gear 17 is provided with a hole 19 that is eccentric to the periphery thereof and forms a tool holding opening in the gear. In this eccentric hole is rotatably fitted a ring-shaped tool or an eccentric ring roll 26. The eccentric ring roll 26 has a round hole 27 defined by an inner ring roll surface 28 which converges from the entry side (the left-hand side in FIG. 1) toward the exit side and expands slightly near the exit end. The gear 17, tool holding opening 19 and ring-shaped tool 26 are linearly disposed in the direction of the radius thereof, with the gear 17 firmly supported by the housing 11 on circumferential portions 17*a* of both end faces thereof.

Bushings 31 and 32 are attached to the housing 11 on both sides of the gear chamber 12. Support ring rolls 35 and 39 are rotatably fitted in the bushings 31 and 32, respectively. The support ring rolls 35 and 39 have round holes 36 and 40 which are shaped similar to the one in the eccentric ring roll 26.

In the embodiment shown in FIGS. 1 and 2, the centers of the gear 17 and the holes 36 and 40 in the support ring rolls 35 and 39 are on the mill center line H. The dimension and position of the hole 27 in the eccentric ring roll and the holes 36 and 40 in the support ring rolls must be such that the pipe 1 is supported by the hole surfaces 37 and 41 in the support ring rolls 35 and 39, with the working face 28 of the eccentric ring roll 26 pressed against the pipe 1, as shown in FIGS. 1 and 2.

A method of forming a pipe using the apparatus described above will be described hereunder.

When the gear 17 is rotated by the motor 23, the internal surface of the tool holding opening 19 of the gear 17 rotates eccentrically since the center thereof is eccentric to the center K of the gear 17, whereby the eccentric ring roll 26 supported by said internal surface and the hole 27 provided therein rotate eccentrically. At this time, the center L of the hole 27 makes a circular motion about the center K of the housing 11 and the gear 17, with a radius LK.

Using a pusher 47, the pipe 1 through which a mandrel 45 is passed is forced into the hole 27 in the ring-shaped tool, namely the eccentric ring roll 26.

The pipe 1 is pushed in by means of the mandrel 45 and the pusher 47. Held between the mandrel 45 and the eccentric ring roll 26 and support ring rolls 35 and 39, the pipe 1 is caused to advance by the frictional force developed between itself and the mandrel 45. The pusher 47 is moved back and forth by a hydraulic actuator, pinion-and-rack combination or other similar mechanism (not shown). The pushing speed is selected according to pipe size, draft or reduction ratio, and other factors. The rear end of the pipe 1 may be pushed directly, instead of pushing on the mandrel 45.

With the eccentric ring roll 26 being rotated while pushing forward the pipe 1, the portion pressed by the inner ring roll surface 28 of the hole 27 in the eccentric ring roll and plastically deformed advances over the circumference of the pipe 1, with the result that the overall pipe wall thickness reduction is achieved. Pressed by the eccentric ring roll 26, the wall thickness of the pipe 1 is reduced also by the action of the supporting devices, namely the support ring rolls 35 and 39. The portion plastically deformed thereby rotates in the same direction at an angular distance of substantially 180 degrees apart from the portion plastically deformed by the eccentric ring roll 26, thereby reducing wall thickness over the entire circumference of the pipe. When this working is carried out while feeding the pipe 1 forward, wall thickness is reduced spirally. But wall thickness variation can be kept within the commercially acceptable limit by providing a parallel portion in the working face of the ring rolls 26 and 39 and making the rotating speed of the eccentric ring roll 26 sufficiently larger than the advancing speed of the pipe 1. While it is desirable to support the eccentric ring roll 26 with a minimum of frictional resistance, the supporting ring rolls 35 and 39 should preferably be supported with large enough frictional resistance to keep the pipe being rolled from rotating. The rotation of the pipe being rolled can be controlled by means of the mandrel, pusher, ring rolls preceding and following the eccentric ring roll, and other equipment or parts that come in direct or indirect contact with the pipe.

The following paragraphs describe an example of a pipe forming operation according to this invention. When rolled on the apparatus shown in FIG. 1 under the conditions listed in Table 1, a hollow shell having an outside diameter of 78 mm and a wall thickness of 24 mm is formed into a pipe with an outside diameter of 42 mm and a wall thickness of 5.0 mm at the exit end thereof. The resulting ratio between the cross-sectional areas at the entry and exit ends is 7.0, which is far larger than the maximum ratio of 4.0 that is available with a conventional 8-stand mandrel mill.

TABLE 1

| Description | Condition |
|---|---|
| Shell material | Plasticine |
| Shell outside diameter (mm) | 78 |
| Shell wall thickness (mm) | 24 |
| Shell cross-sectional area ($mm^2$) | 4072 |
| Finished outside diameter (mm) | 42 |
| Finished wall thickness (mm) | 5.0 |
| Finished cross-sectional area ($mm^2$) | 581 |
| Cross-sectional area ratio between entry and exit ends | 7.0 |
| Diameter of hole 36 (mm) | 80 |
| Diameter of hole 27 (mm) | 80 |
| Diameter of hole 40 (mm) | 44 |
| Diameter of mandrel (mm) | 28 |
| Eccentricity $\overline{KL}$ (mm) | 10 |
| Revolution of gear (rpm) | 60 |
| Shell feed rate (mm/sec.) | 1.0 |

As will be obvious from the above description, the forming principle according to this invention is as applicable to bars as to pipes.

Figure 3:
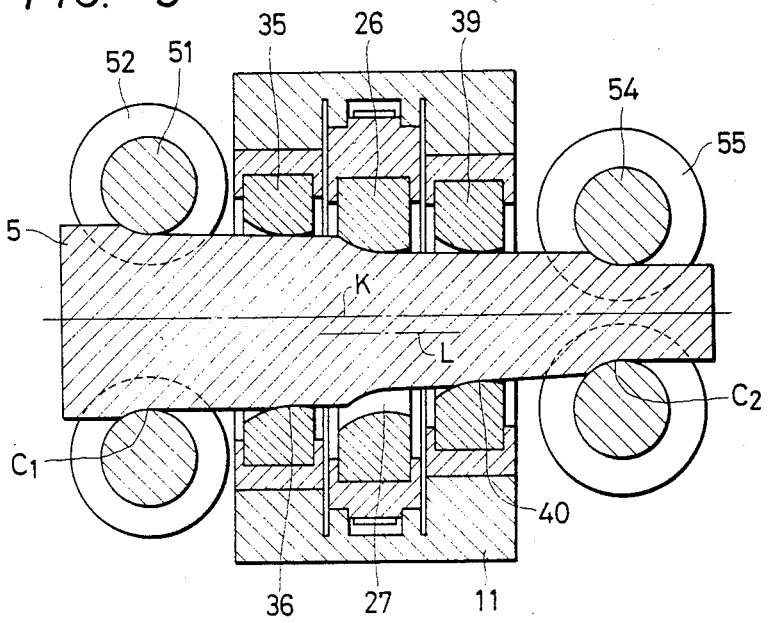
FIG. 3 is a longitudinal cross section of a bar forming apparatus on which a forming method of this invention is implemented.

FIG. 3 shows a bar forming apparatus on which bars are formed according to a forming method of this invention. Similar to those used for pipe forming, the housing, gear, eccentric and support ring rolls, and some other parts are designated by the same reference numerals as those used in FIGS. 1 and 2, and the detailed description thereof has been omitted.

As shown in FIG. 3, two pairs of grooved rolls 51 and 54 are adjoiningly disposed on the entry and exit sides of a housing 11. The grooved rolls 51 and 54 are provided with semicircular passes 52 and 55, respectively.

Rotatingly driven, the grooved rolls 51 and 54 roll a bloom 5 and, at the same time, impart an advancing force thereto. Tension is applied to the bloom 5 by making the peripheral speed of the exit-side grooved rolls 54 greater than that of the entry-side rolls by a given amount, or, in other words, by making the product of the peripheral speed of the exit-side roll 54 and the cross-sectional area of the piece 5 thereat larger than the product of the peripheral speed of the entry-side rolling roll 51 and the cross-sectional area of the piece 5 thereat, thereby enhancing the bloom diameter reducing effect of the eccentric ring roll 26.

A pusher 47 to apply a pushing force to the rear end of the bloom, like the one shown in FIG. 1, can be added to the apparatus shown in FIG. 3.

The following paragraphs describe an example of a bar forming operation according to this invention. When rolled on the apparatus shown in FIG. 3 under the conditions listed in Table 2, a bloom having a diameter of 80 mm is rolled into a bar with a diameter of 40 mm at the exit end thereof. The resulting elongation ratio (or the cross-sectional ratio) stands at a sufficiently high level of 4.

TABLE 2

| Description | Conditions |
|---|---|
| Bloom material | Plasticine |
| Bloom diameter (mm) | 80 |
| Bloom cross-sectional area ($mm^2$) | 5027 |
| Finished diameter (mm) | 40 |
| Finished cross-sectional area ($mm^2$) | 1257 |
| Elongation (cross-sectional) ratio | 4.0 |
| Longer diameter of bloom at $C_1$ (mm) | 80 |
| Shorter diameter of bloom at $C_1$ (mm) | 70 |
| Diameter of hole 36 (mm) | 80 |
| Diameter of hole 27 (mm) | 80 |
| Diameter of hole 40 (mm) | 44 |
| Diameter of bar at $C_2$ (mm) | 40 |
| Eccentricity $\overline{KL}$ (mm) | 10 |
| Revolution of gear (rpm) | 60 |
| Bloom feed rate (mm/sec.) | 1.0 |

In the two embodiments described above, an eccentric ring roll is rotatably supported inside a gear. Therefore, shear strain can be minimized by adjusting the relative speeds thereof so that the slip between the working face of the eccentric ring roll and the surface of the cylindrical product in the rotating direction becomes substantially minimum and, thereby, causing the eccentric ring roll to rotate over the surface of the cylindrical product.

In addition to the general description of the two basic embodiments, different variations of some component elements will be described hereunder.

The eccentric ring roll may be supported by an annular holder, instead of the gear. The annular holder can have an eccentric hole in which the eccentric ring roll is rotatably fitted. The annular holder can be rotated by a belt or a chain (in the latter case, teeth are cut on the external periphery of the annular holder) passed thereover with the center axis thereof matched to the mill center line.

Even with a stationary eccentric ring roll, the same effect can be attained by giving a motion similar to the above-described one to the cylindrical product by means of a holder.

In the foregoing embodiments, the cylindrical product upon which the inner ring roll surface constituting the working face of the hole in the eccentric ring roll exerts a forming force is supported by the support ring rolls. But the cylindrical product may instead be supported by a pair of rolls having a semicircular pass that are disposed on both sides of the eccentric ring roll, or otherwise by a plurality of eccentric ring rolls that are placed next to one another. In the latter case, still greater reduction can be achieved, and, for achieving such heavier reduction, it is preferable to allow the holes in the adjoining eccentric ring rolls to rotate eccentrically with a phase difference by 180 degrees and at the same angular speed. Equipment size can be reduced by accommodating two or more eccentric ring rolls in one gear or by coupling the gear 17 to the adjoining bushings 31 and 32.

In implementing the forming method of this invention, a thrust must be applied to push the cylindrical product in the longitudinal direction thereof. In the embodiments described before, this thrust is provided by pushing the rear end of the cylindrical product or, in the case of pipes, by pushing the mandrel passed therethrough. It is also possible to exert a pushing or pulling force on the cylindrical product by means of grooved driven rolls provided on the entry or exit side of the eccentric ring roll.

Exertion of a pushing or pulling force on the cylindrical product increases the working speed. Meanwhile, keeping the feed rate constant permits uniform forming of cylindrical products.

The following are the methods of enhancing the working efficiency.

Figure 4:
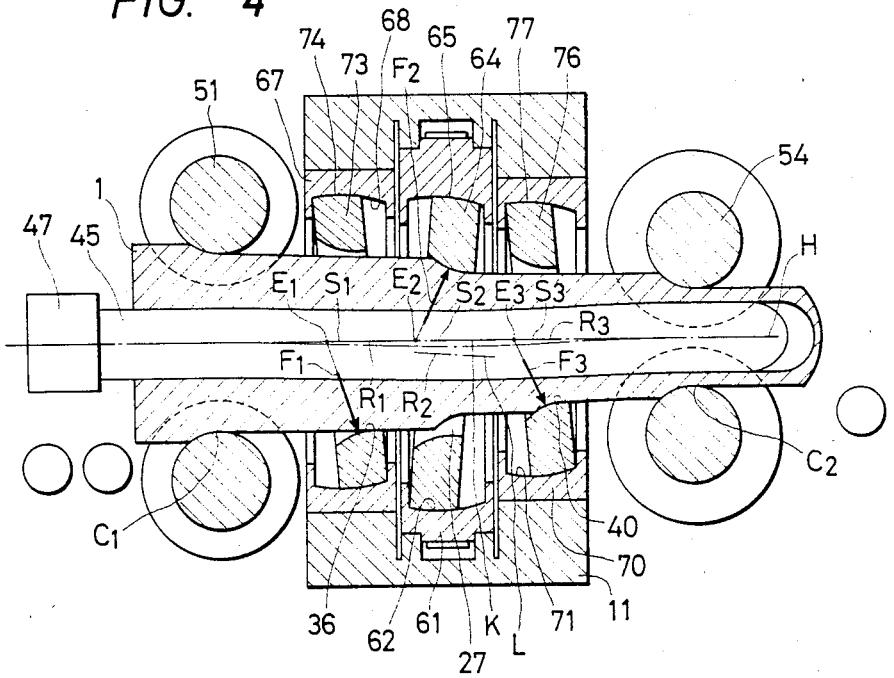
FIG. 4 is a longitudinal cross section of a forming apparatus with a ring-shaped tool attached in a tiltable fashion on which another forming method of this invention is implemented.

As shown in FIG. 4, an eccentric ring roll 64 having a convex periphery 65 is supported by a concave surface inside a gear 61 and support ring rolls 73 and 76 having convex peripheries 74 and 77 are supported by concave surfaces 68 and 71 of bushings 67 and 70, respectively, in such a manner as to be tiltable from a plane perpendicular to the mill center line H.

The ring rolls are tilted so that:

(1) the centers $R_1$, $R_2$ and $R_3$ of the smallest diameters of the holes in the support ring roll 73, eccentric ring roll 64 and support ring roll 76 (hereinafter generically called the ring rolls) are offset toward the exit side from the centers $S_1$, $S_2$ and $S_3$ of the concave surfaces supporting the ring rolls, respectively; and (2) the intersection points $E_1$, $E_2$ and $E_3$ where vectors $F_1$, $F_2$ and $F_3$ of rolling reaction forces cross the mill center line H are offset toward the entry side from the centers $S_1$, $S_2$ and $S_3$ of the concave surfaces supporting the ring rolls, respectively.

When rolling is effected with this apparatus the force exerted toward the exit side in the direction in which the ring rolls contact the workpiece becomes greatest. As the gear rotates, the contact surface of the holes in the ring rolls move over the periphery of the workpiece and toward the exit end, thereby causing the workpiece to move forward smoothly. The tilting of the ring rolls permits a heavy reduction of pipe wall thickness by decreasing the distance between the ring rolls and the mandrel.

FIG. 4 shows three types of driving means. In rolling a closed-end pipe 1 with the frictional force between the shell and the mandrel, a mandrel driving means 47 applies a driving force to the pipe by pushing the closed end thereof and the front end of the mandrel until the front end of the pipe has been rolled.

The driven entry-side grooved rolls 51 roll the pipe 1, apply a driving force to the pipe mandrel, and restrict the rotation of the pipe. The driven exit-side grooved rolls 54 roll the pipe, apply frictional force to the pipe and mandrel, restrict the rotation of the pipe, and, furthermore, adjust the outside diameter, wall thickness and smoothness of the surface of the pipe.

Figure 5:
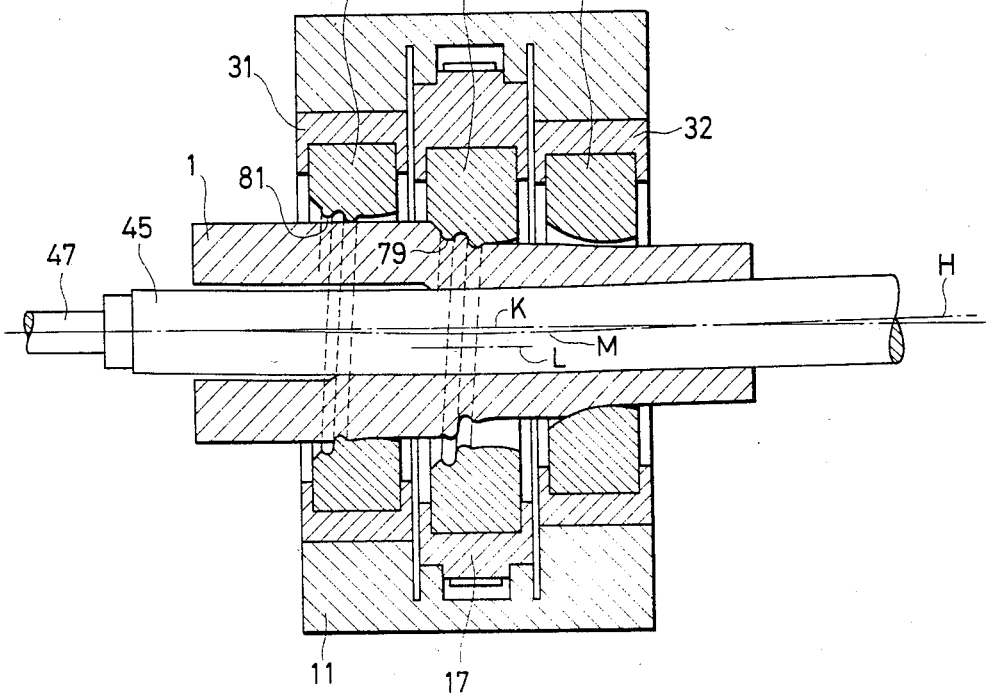
FIG. 5 is a longitudinal cross section of a forming apparatus equipped with a ring-shaped tool having a thread-like ridge on which still another forming method of this invention is implemented.

FIG. 5 shows an embodiment in which pipe is formed by means of ring rolls having irregularities on the inner ring roll surface constituting the working face of the holes thereof.

Figure 6:
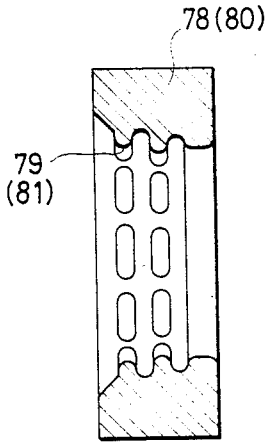
FIGS. 6 and 7 are longitudinal cross sections of examples of ring-shaped tools having a thread-like ridge.
Figure 7:
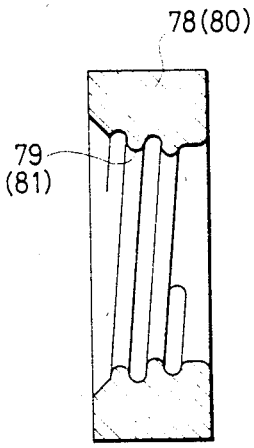

Irregularities 79 and 81 are provided along the circumference of the working face of the holes in an eccentric ring roll 78 and en entry-side support ring roll 80. The irregularities 79 and 81 may be intermittent around the periphery as shown in FIG. 6 or composed of helical ridges as shown in FIG. 7.

With the irregularities 79 and 81 biting into the surface of the pipe 1, efficient working is achieved with this type of ring rolls 78 and 80. Especially when the irregularity 82 in the hole of the eccentric ring roll is a spirally cut internal thread as shown in FIG. 7, efficient, high-speed working is attained by causing the ring roll and cylindrical product to move relative to each other so that the irregularity moves toward an unworked portion of the latter. For the relative motion of the ring roll 78 and cylindrical product, the former rotates clockwise when viewed from the exit end (or the right-hand side in the figure) when the thread thereon is cut clockwise as shown in FIG. 7 and the cylindrical product advances from left to right without rotating.

Table 3 shows three examples in which pipe is formed using three types of eccentric ring rolls with differently shaped holes. Example 1 uses eccentric ring rolls whose holes have circular cross sections as shown in FIG. 1. The holes $D_1$, $D_2$ and $D_3$ of the eccentric ring rolls used in Example 2 are provided with intermittent projections 79 as shown in FIG. 6. The holes of the eccentric ring rolls in Example 3 have helical ridges 79 as shown in FIG. 7. Other conditions than the cross-sectional shape of the ring roll holes are common to all examples. The workpiece is caused to advance by pushing the mandrel 45 at a speed of 10 mm/sec. In Table 3, the ring roll holes are numbered 1, 2 and 3 from the entry side of the forming apparatus. The rolled piece leaves the exit end at a speed of 4, 9 and 13 m/sec in Examples 1, 2 and 3. The speeds in Examples 2 and 3 are more than twice and three times higher than that in Example 1, testifying to the effectiveness of the method and apparatus according to this invention.

TABLE 3

| Description | Example 1 | Example 2 | Example 3 |
|---|---|---|---|
| Shape of ring roll hole | FIG. 1 | FIG. 6 | FIG. 7 |
| Mandrel diameter (mm) | 38 | " | " |
| Eccentricity $\overline{KL}$ of hole No. 1 (mm) | 6 | " | " |
| Eccentricity $\overline{KL}$ of hole No. 2 (mm) | 10 | " | " |
| Eccentricity $\overline{KL}$ of hole No. 3 (mm) | 6 | " | " |
| Minimum inside diameter $D_1$ of hole No. 1 (mm) | 84 | " | " |
| Minimum inside diameter $D_2$ of hole No. 2 (mm) | 80 | " | " |
| Minimum inside diameter $D_3$ of hole No. 3 (mm) | 66 | " | " |
| Phase difference between holes Nos. 2 and 3 (degree) | 180 | " | " |
| Mandrel feed speed (mm/sec) | 10 | " | " |
| Gear revolution (rpm) | 60 | " | " |
| Shell material | Plasticine | " | " |
| Shell outside diameter (mm) | 80 | " | " |
| Shell wall thickness (mm) | 20 | " | " |
| Finished wall thickness (mm) | 9.3 | 9.1 | 8.8 |
| Finished outside diameter (mm) | 58.2 | 58.0 | 57.8 |
| Exit-end clearance speed (mm/sec) | 4 | 9 | 13 |

Figure 8:
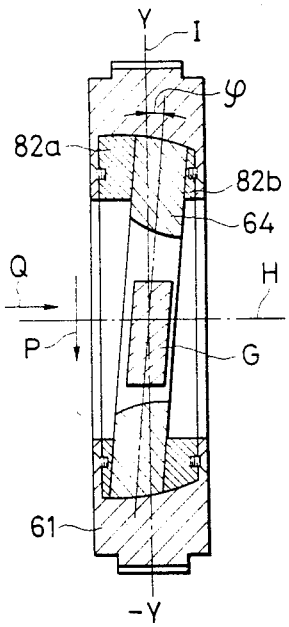
FIG. 8 shows a part of the forming apparatus of FIG. 4 with the ring-shaped tool thereof tilted at a fixed angle.
Figure 9:
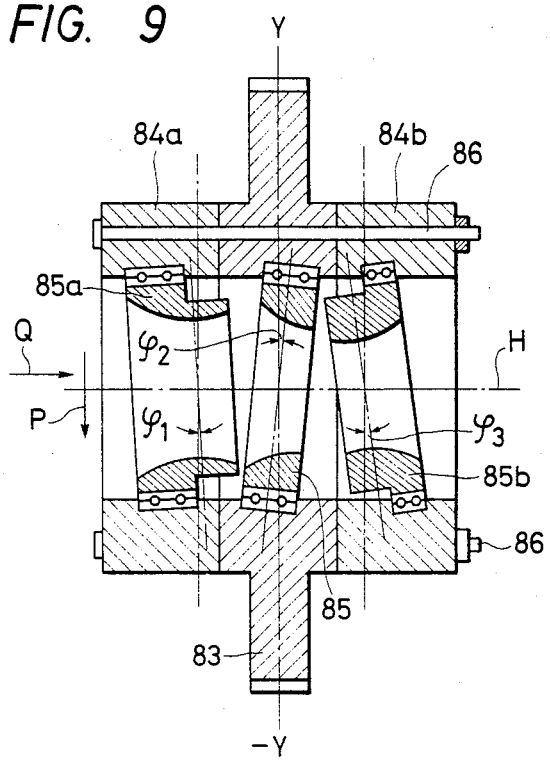
FIG. 9 is a longitudinal cross section of another forming apparatus according to this invention which is equipped with a tilted ring-shaped tool.

According to this invention, the cylindrical product can be sent forward positively. FIG. 8 shows a ring roll 64 that is tilted at an angle $\phi$ with respect to a plane perpendicular to the mill center line H, that is, the axis of rotation of the ring roll is inclined by an angle $\phi$ with respect to the mill center line H, in an area G where the cylindrical product contacts the ring roll. When a gear 61 is moved under this condition in the direction indicated by the arrow P or, in other words, counterclockwise when viewed from the entry side, the ring roll 64 causes the cylindrical product to advance in the direction indicated by the arrow Q in the contact area G with an angular advance $\phi$. That is, the tool holder is rotated along with the gear in the direction in which the ring-shaped tool in contact with the cylindrical product is inclined forward. The ring roll can be tilted by, for example, making the thickness of spacers 82*a* and 82*b* in the direction (Y axis) that is orthogonal to the direction (X axis) in which the ring roll hole is offset different. The angle $\phi$ can be adjusted by varying the taper in the thickness of the spacers 82*a* and 82*b*. FIG. 9 shows ring rolls 85, 85*a* and 85*b* that are fastened to a gear 83 and bushings 84*a* and 84*b* at fixed angles. When two or more eccentric ring rolls are connected and driven together by a coupling rod 86 as shown in FIG. 9, the best rolling result is obtained if the n-th ring-shaped tool from the entry side is supported by a tool holder at an angle $\phi_n$, which can be expressed by the following equation, with respect to a plane perpendicular to the mill center line H at a point where the ring-shaped tool contacts the cylindrical product.

$$\phi_{n-1} \leqq \phi_n \leqq 2\frac{A_{n-1}}{A_n}\phi_{n-1}$$

$A_{n-1}$ and $A_n$ are the cross-sectional areas of the workpiece before and after being worked through the n-th ring-shaped tool from the entry side. $A_0$ is the cross-sectional area of the starting hollow shell. $A_2$ and the following are gradually decreasing values determined in designing ring roll holes. $\phi_0$ is the quotient resulting from the division of the amount of workpiece feed $l_0$ achieved by each rotation of the ring roll holder by the peripheral length $m_0$ of the workpiece ($\phi_0 = l_0/m_0$). The lower limit shown on the left-hand side of the above equation means that the n-th ring roll provides an advancing speed higher than that which is provided by the (n−1)-th ring roll, or that rolling is continued smoothly without developing any halt between the two ring rolls. If the first coefficient in the upper limit shown on the right-hand side of the above equation exceeds 1, tension develops between the (n−1)-th and n-th ring rolls. If the same coefficient exceeds 2, the forming action becomes so severe that the probability of surface defects development increases. However, the upper limit can be raised further by technical improvement. The direction in which the ring rolls are inclined is as shown in FIG. 9. As is apparent, adjoining ring rolls are inclined in opposite directions. In the position where each rolling roll comes in contact with the cylindrical pipe, however, each roll is inclined in the same direction.

Ring rolls that effect substantially no forming, such as the rearmost one, may sometimes deviate from the range defined by the above equation.

Figure 10:
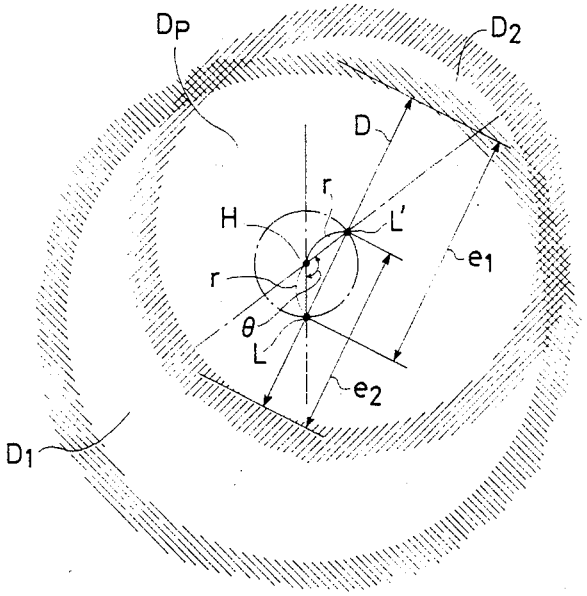
FIG. 10 illustrates a method in which the outside diameter of a cylindrical product is controlled by varying the phase difference between two eccentrically rotating ring-shaped tools.

According to the forming method of this invention, the dimensions of the cylindrical product are determined mainly by the diameter of the holes in the ring rolls and the amount of eccentricity with which the holes are rotated. In the method described below, a plurality of eccentric ring rolls are adjoiningly disposed and driven so that the holes of the adjacent rolls rotate eccentrically with a phase difference and at the same angular speed. By varying the phase difference, the shorter diameter of the cylindrical product can be adjusted. Wall thickness can be determined by reducing the mandrel diameter. FIG. 10 illustrates the principle of the operation just described.

In FIG. 10, a hole $D_1$ is centered at a point L that is spaced from the mill center H by a distance r and a hole $D_2$ at a point L', the two holes rotating at the same angular speed, with a given amount of phase difference $\theta$. If the radii of the holes $D_1$ and $D_2$ are $e_1$ and $e_2$, the diameter D of the circle inscribed in a forming hole $D_p$ formed by the two holes is expressed as $D = e_1 + e_2 - 2r \cdot \sin\theta/2$. The outside diameter of the cylindrical product formed becomes somewhat larger than the diameter D of the inscribed circle and smaller than the diameters of the ring roll holes. When a mandrel having a radius $R_M$ is inserted, the wall thickness of the pipe can be expressed substantially by $(D - 2R_M)/2$. Accordingly, the outside diameter and wall thickness of the pipe can be changed by varying the value of $\theta$ in the midst of rolling.

Figure 11:
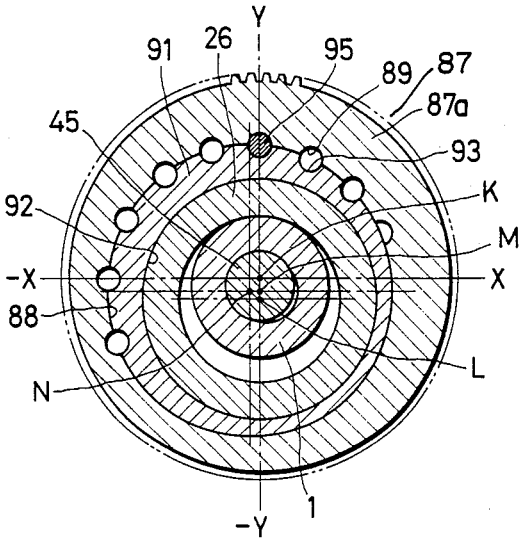
FIG. 11 is a front cross-sectional view of an apparatus equipped with a mechanism to adjust the eccentricity of a ring-shaped tool.
Figure 12:
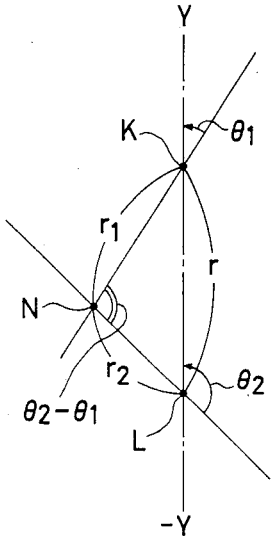
FIG. 12 illustrates the principle by which the eccentricity of a ring-shaped tool is adjusted on the apparatus shown in FIG. 11.

FIGS. 11 and 12 illustrate a method of adjusting the amount of eccentricity of the eccentric ring roll.

As shown in FIG. 11, a gear 87 is provided with an outer gear portion 87*a* having an eccentric hole 88 in which a cylinder 91 is rotatably fitted. The cylinder 91 also has an eccentric hole 92 constituting the tool holding opening in which an eccentric ring roll 26 is rotatably fitted.

In FIG. 12, the length of a line segment $\overline{KN}$ connecting shaft center K of the gear 87 and the center N of the hole 88 is $r_1$ and the angle formed between the extension of the line segment $\overline{KN}$ and a line connecting Y and −Y about which axial symmetry is formed is $\theta_1$. Also, the length of a line segment $\overline{NL}$ connecting the centers of the internal and external circles defining the cylinder 91 is $r_2$ and the angle formed between the extension of the line segment $\overline{NL}$ or a line about which the cylinder 91 is axisymmetrically rotated and said line connecting Y and −Y is $\theta_2$. Under these conditions, the center L of the hole in the eccentric ring roll 26 is made eccentric by the two eccentric holes 88 and 92 with respect to the shaft center K of the gear 87 by the amount r which is expressed as $$r = \sqrt{r_1^2 + r_2^2 + 2r_1r_2 \cdot \cos(\theta_2 - \theta_1)}$$

As may be evident from this equation, the amount of eccentricity can be controlled by varying the value of $(\theta_2 - \theta_1)$.

When $\theta_1$ is equal to $\theta_2$, or when the gear 87 and the inscribing cylinder 91 are eccentric in the same direction, the above equation gives the largest value $r_1 + r_2$. When $\theta_2 - \theta_1$ is equal to 180 degrees, or when the gear 87 and the inscribing cylinder 91 are eccentric in opposite directions, the above equation gives the smallest value $|r_1 - r_2|$. By appropriately choosing the value of $\theta_2 - \theta_1$, an intermediate value between the maximum and minimum can be obtained. This choice can be achieved by inserting a key 95 in one of a plurality of keyways each of which is made up of semicircular cuts 89 and 92 made along the wall of the gear hole 88 and the periphery of the cylinder 91. This offers a wide range of choice for the eccentricity r of an eccentric ring roll. This mechanism is compact and possesses extremely high rigidity.

In pipe forming, wall thickness t is given by the following equation:

$$t = R_r - r - R_M - m + C$$

wherein $R_r$ is the radius of the hole in the eccentric ring roll, r the eccentricity of the same hole, $R_M$ the radius of the mandrel, m the eccentricity of the mandrel, and C a constant concerning the rigidity of the mandrel and forming apparatus. As is evident, wall thickness t can be changed by adjusting the eccentricity m of the mandrel even if the diameter and eccentricity of the hole in the eccentric ring roll and the mandrel diameter are fixed. The mandrel eccentricity m can be adjusted by shifting the mandrel axis away from the mill center line by use of the mandrel support.

As the eccentric ring roll rotates during the pipe forming operation, the pipe is likely to rotate in the same direction and thus develop a kink. A kink in pipe is, of course, undesirable from the viewpoint of later application and appearance. In addition, it might lead to the development of surface defects. Especially, heavy kinks develop spiral irregularities or lines that might cause serious surface defects or uneven deformation.

In the following embodiment, the kink is reduced by allowing the mandrel to move in the direction opposite to the direction in which the eccentric ring roll moves relative to the pipe being formed. Furthermore, the kink or rotating speed of the pipe being formed is controlled by regulating the rotating speed of the mandrel based on the signals representing the latest conditions thereof.

Figure 13:
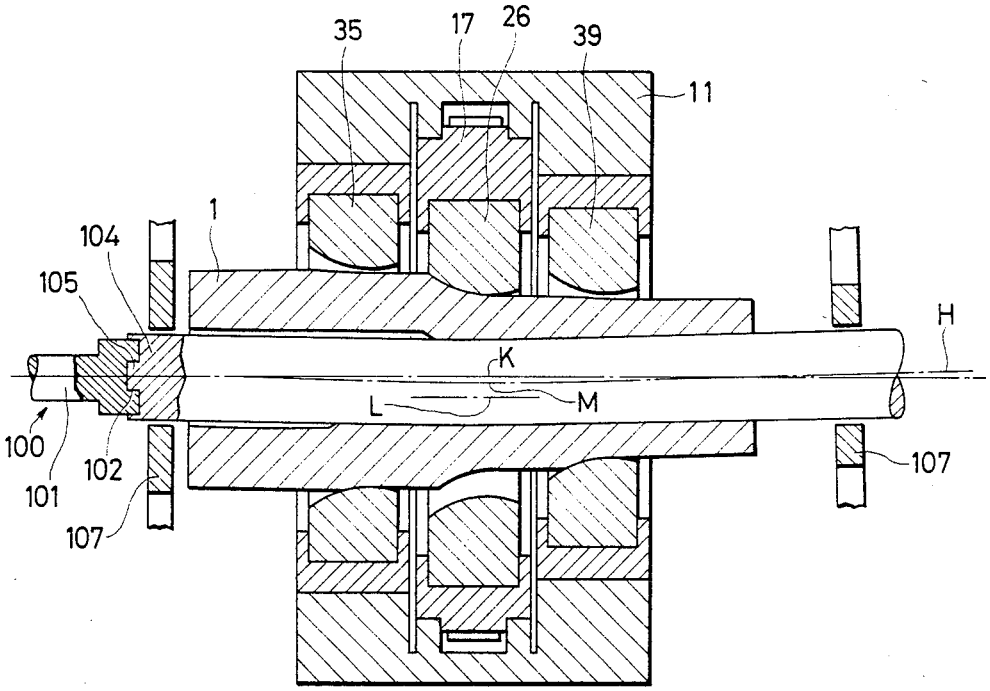
FIG. 13 is a longitudinal cross section of another pipe mill according to this invention which is equipped with a device to push and rotate a mandrel.

The mandrel is rotated by means of a mandrel pusher-rotator 100 as shown in FIG. 13. A mandrel 104 has a projection 105 at the rear end thereof. A groove 102 adapted to engage with said projection 105 is cut in the front end of the rod 101 of the mandrel pusher-rotator 100. The rod 101 is rotatingly pushed forward by a screw mechanism (not shown). The mandrel 104 is supported by, for example, ring-shaped supports 107 disposed on both sides of the housing 11.

Eccentric rotation of the support ring rolls whose centers are offset from the mill center line as shown in FIGS. 1, 3, 4 and 13 can be achieved by connecting the holders thereof to the gear by means of the coupling rod 86 as shown in FIG. 9. By increasing the number of eccentric ring rolls, heavy cross-sectional reduction can be attained with ease.

According to the forming method of this invention, the surface of the cylindrical product may be finished either smooth or with a thread-like projection by choosing a suitable ring-roll hole design, gear rotating speed and workpiece feed rate.

Now, an example of pipe mill layout including a pipe forming apparatus or ring-roll rolling mill according to this invention will be described.

Figure 14:
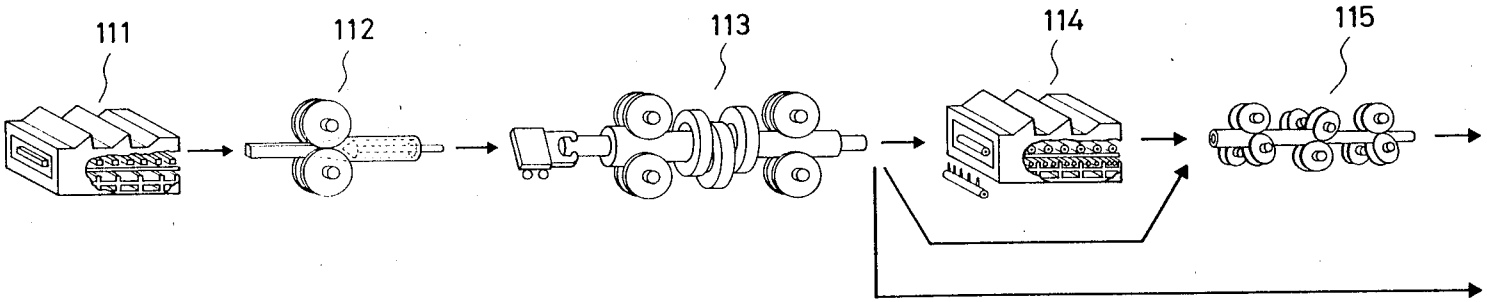
FIG. 14 is a sketch of a layout of a pipe mill containing a pipe forming apparatus according to this invention.

A pipe mill shown in FIG. 14 comprises a reheating furnace 111 to heat a metal bloom to a temperature suited for hot working, a press roll mill 112 to change the cross-sectional shape of the heated bloom from square to tubular or circular, and a ring-roll mill 113 that further reduces the cross-sectional area of the obtained hollow shell. The ring-roll mill 113 is followed by a pipe temperature control device 114 and a stretch reducer 115.

The reheating furnace 111, which should preferably be able to heat square metal blooms uniformly, may be of the walking-beam type, walking-hearth type, rotary-hearth type or otherwise. A shear, descaler and/or weigher may be positioned as desired between the reheating furnace 111 and the press roll mill 112.

The press roll mill 112 essentially has the same structure as that of known press roll piercers. When a plug or mandrel is used, the mill serves as a press roll piercer performing the piercing function based on the principles disclosed in the U.S. Pat. Nos. 4,052,874, 4,190,887, 4,006,618, etc. When used without the plug or mandrel, the press roll mill forms a square bloom into a solid round piece.

The press roll mill of the above type is preferred because the mill permits using square cast blooms thereby dispensing with the primary rolling process, and square cast blooms surpass round cast blooms in quality, yield and interchangeability with other products.

It is preferable that the temperature control device 114 have a function not only to heat the workpiece to a temperature required for the subsequent working on the following stretch reducer 115 but also to cool, before heating, down to a temperature below $Ar_1$ transformation point or $M_f$ point for toughness enhancement in the finished piece. The stretch reducer 115 is of the type that is used with the conventional pipe or rod rolling mills. The stretch reducer 115 heavily reduces the outside diameter of the solid piece or the wall thickness of the hollow shell by means of the tension developed between stands. The stretch reducer 115 according to this invention includes a sizing mill.

Table 4 compares estimated dimensional changes in the manufacture of seamless pipe on the conventional mill train and the one according to this invention.

TABLE 4

| Conventional Mill Train | | Mill Train of This Invention | | |
|---|---|---|---|---|
| Equipment | Cross-sectional Dimensions (mm) | Equipment | Cross-sectional Dimensions - Pipes (mm) | Cross-sectional Dimensions - Bar (mm) |
| Reheating furnace | 215 × 215 | Reheating furnace | 215 × 215 | 215 × 215 |
| ↓ | ↓ | ↓ | ↓ | ↓ |
| Press roll piercer | 253ϕ × 63t | Press roll piercer | 253ϕ × 63t | 225ϕ |
| ↓ | ↓ | ↓ | ↓ | ↓ |
| Elongator | 270ϕ × 19t | ↓ | ↓ | ↓ |
| ↓ | ↓ | ↓ | ↓ | ↓ |
| Sizer | 240ϕ × 20t | ↓ | ↓ | ↓ |
| ↓ | ↓ | ↓ | ↓ | ↓ |
| Mandrel mill | 210ϕ × 6t | Ring-roll mill | 142ϕ × 6t | 142ϕ |
| ↓ | ↓ | ↓ | ↓ | ↓ |
| Reheating furnace | ↓ | Temperature controller | ↓ | ↓ |
| ↓ | ↓ | ↓ | ↓ | ↓ |
| ↓ | ↓ | ↓ | ↓ | ↓ |
| Stretch reducer | 114.3ϕ × 5t | Stretch reducer | 76.3ϕ × 5t | 76.3ϕ |

The conventional mill train comprising seven steps, five steps of which perform rolling, provides an outside diameter of 114.3 mm after the stretch reducer. The mill train of this invention comprising five steps, three of which performing rolling, produces from the same material a pipe and a bar having an outside diameter of 76.3 mm. The outside diameter reduction rate (outside diameter difference between entry and exit ends/outside diameter at entry end x 100%) at the stretch reducer is 46 percent.

As described above, the use of the ring-roll mill permits decreasing the number of rolling mills in a mill train, attaining heavy cross-sectional reduction, and manufacturing both pipes and bars on the same apparatus. The difference between pipe and bar rolling is only that no mandrel is used on the press roll mill 112 and the ring-roll mill 113 for the latter.

It is preferable to design the rolling mill train to allow a choice from among the following three combinations as shown in FIG. 14: (a) the reheating furnace 111 plus the press roll mill 112 plus the ring-roll mill 113; (b) the combination (a) plus the stretch reducer 115; and (c) the combination (a) plus the temperature controller 114 and the stretch reducer 115. This provision expands the range of manufacturing ability and permits omitting some steps as required. The combination (a) is suited for the manufacture of products with relatively large cross sections, (b) for products with relatively small cross sections demanding only a moderate degree of conformance to dimension and quality specifications, and (c) for products with relatively small cross sections demanding a high degree of conformance to dimension and quality specifications. This general concept applies to both pipes and bars.

What is claimed is:

1. An apparatus for forming a cylindrical metal product, comprising:

a housing having a housing axis therethrough aligned with a mill center line;

a gear means disposed in said housing and having circumferential portions of both end faces rotatably supported in said housing for rotation about said housing axis, said gear means having a tool holding opening therein the axis of which is offset from the mill center line;

a pinion engaged with said gear means for driving said gear means;

at least one ring-shaped tool slidable rotatably fitted in said tool holding opening in said gear means and radially aligned with said gear means and having an inner surface shaped for circularly turning the outer surface of a metal workpiece to be formed into the cylindrical metal product by the rotation of said gear means;

means for moving the metal workpiece through said housing along said housing axis; and supporting means disposed upstream and downstream and closely adjacent said ring-shaped tool in the direction in which the metal workpiece is moved and having a shape defining a workpiece supporting hole therethrough for supporting the metal workpiece in said supporting hole as said ring-shaped tool acts on the outer surface of the workpiece.

2. An apparatus according to claim 1 further comprising at least two rolling mill stands each having a pass coaxial with said mill center line, at least one disposed adjacent said housing upstream thereof and at least one disposed adjacent said housing downstream thereof in the direction in which the metal workpiece is moved.

3. An apparatus according to claim 2 in which said means for moving the metal workpiece is in axially movable mandrel coaxial with the mill center line.

4. An apparatus according to claim 2 in which said means for moving the metal workpiece comprises at least two rolling mill stands each having a pass coaxial with said mill center line, at least one disposed adjacent said housing upstream thereof and at least one disposed adjacent said housing downstream thereof in the direction in which the metal workpiece is moved.

5. An apparatus according to claim 4 in which said moving means further comprises an axially movable mandrel coaxial with the mill center line.

6. An apparatus according to claim 4 in which said supporting means comprises at least two rolling mill stands each having a workpiece supporting hole therein in the form of a pass defined by the rolls thereof, at least one disposed adjacent said ring-shaped tool upstream thereof and at least one disposed adjacent said ring-shaped tool downstream thereof in the direction in which the metal workpiece is moved.

7. An apparatus according to claim 1 in which said gear means comprises:

an outer gear portion having the axis of rotation thereof aligned with the mill center line and having a hollow interior defined by an inner surface and the axis of which is offset from said mill center line, said inner surface having a plurality of semicircular grooves therein extending parallel to the axis thereof;

a cylinder fitted in said hollow interior of said outer gear portion and having an outer surface having a plurality of semicircular grooves therein extending parallel to the axis thereof and having a hollow interior the axis of which is offset from said mill center line;

a key fitted in two radially aligned grooves for locking said cylinder to said outer gear portion; and an eccentric ring roll which is slidably rotatably fitted in said hollow interior of said cylinder; whereby the amount by which said eccentric ring roll is offset from the mill center line can be adjusted by placing said key in different aligned pairs of the semicircular grooves.

8. An apparatus according to claim 1 in which there are at least three ring-shaped tools provided along said mill center line, the axial end surfaces of said tools being alternately inclined in opposite directions to a plane perpendicular to the mill center line, the inclination of successive ring-shaped tools increasing progressively in the direction in which the metal workpiece travels, the axis of the ring-shaped tools being offset from said mill center line so that the shortest distance between the inner surface of said ring-shaped tools and the mill center line is less than the radius of the metal workpiece, the axial end surfaces of each of the ring-shaped tools being inclined toward the direction in which the metal workpiece travels at the positions where the ring-shaped tools are in contact with the metal workpiece, all of said ring-shaped tools being fitted in said gear means for, in addition to reducing the workpiece, constituting at least part of said means for moving the workpiece along the housing axis.

9. A mill train for making a metal pipe or bar, comprising:

a reheating furnace for heating a metal bloom to a temperature suited for hot working;

a press roll forming mill positioned for receiving a hot bloom from said reheating furnace and for changing the metal bloom into a hollow or solid cylindrical cross-sectional piece; and an apparatus for forming a cylindrical metal product for receiving the piece from said press roll forming mill and comprising:

a housing having a housing axis therethrough aligned with a mill center line;

a gear means disposed in said housing and having circumferential portions of both end faces rotatably supported in said housing for rotation about said housing axis, said gear means having a tool holding opening therein the axis of which is offset from the mill center line;

a pinion engaged with said gear means for driving said gear means;

at least one ring-shaped tool slidable rotatably fitted in said tool holding opening in said gear means and radially aligned with said gear means and having an inner surface shaped for circularly turning the outer surface of a metal workpiece to be formed into the cylindrical metal product by the rotation of said gear means;

means for moving the metal workpiece through said housing along said housing axis; and supporting means disposed upstream and downstream and closely adjacent said ring-shaped tool in the direction in which the metal workpiece is moved and having a shape defining a workpiece supporting hole therethrough for supporting the metal workpiece in said supporting hole as said ring-shaped tool acts on the outer surface of the workpiece.

10. A method of forming a cylindrical metal product by the use of an apparatus having a housing having a housing axis therethrough aligned with a mill center line; a gear means disposed in said housing and having circumferential portions of both end faces rotatably supported in said housing for rotation about said housing axis, said gear means having a tool holding opening therein the axis of which is offset from the mill center line; a pinion engaged with said gear means for driving said gear means; at least one ring-shaped tool slidable rotatably fitted in said tool holding opening in said gear means and radially aligned with said gear means and having an inner surface shaped for circularly turning the outer surface of a metal workpiece to be formed into the cylindrical metal product by the rotation of said gear means; means for moving the metal workpiece through said housing along said housing axis; and supporting means disposed upstream and downstream and closely adjacent said ring-shaped tool in the direction in which the metal workpiece is moved and having a shape defining a workpiece supporting hole therethrough for supporting the metal workpiece in said supporting hole as said ring-shaped tool acts on the outer surface of the workpiece, and at least two rolling mill stands each having a pass coaxial with said mill center line, at least one disposed adjacent said housing upstream thereof and at least one disposed adjacent said housing downstream thereof in the direction in which the metal workpiece is moved; said method comprising the steps of:

setting the peripheral speed of the rolls in the upstream rolling mill stand and the downstream rolling mill stand in a range in which a tensile force acts on the metal workpiece;

rotating the gear means for rotating said ring-shaped tool for radially compressing the metal workpiece between said ring-shaped tool and the supporting means.

11. A method of forming a cylindrical metal product by the use of an apparatus having a housing having a housing axis therethrough aligned with a mill center line; a gear means disposed in said housing and having circumferential portions of both end faces rotatably supported in said housing for rotation about said housing axis, said gear means having a tool holding opening therein the axis of which is offset from the mill center line; a pinion engaged with said gear means for driving said gear means; at least one ring-shaped tool slidable rotatably fitted in said tool holding opening in said gear means and radially aligned with said gear means and having an inner surface shaped for circularly turning the outer surface of a metal workpiece to be formed into the cylindrical metal product by the rotation of said gear means; means for moving the metal workpiece through said housing along said housing axis; and supporting means disposed upstream and downstream and closely adjacent said ring-shaped tool in the direction in which the metal workpiece is moved and having a shape defining a workpiece supporting hole therethrough for supporting the metal workpiece in said supporting hole as said ring-shaped tool acts on the outer surface of the workpiece, and at least two rolling mill stands each having a pass coaxial with said mill center line, at least one disposed adjacent said housing upstream thereof and at least one disposed adjacent said housing downstream thereof in the direction in which the metal workpiece is moved; said method comprising the steps of:

setting the peripheral speed of the rolls in the upstream rolling mill stand and the downstream rolling mill stand in a range in which a range in which the product of the peripheral speed of the rolling rolls upstream of the housing and the cross-sectional area of the metal workpiece thereat is larger than the product of the peripheral speed of the rolling rolls downstream of the housing and the cross-sectional area of the metal workpiece thereat;

rotating the gear means for rotating said ring-shaped tool for radially compressing the metal workpiece between said ring-shaped tool and the supporting means.

* * * * *